US008297337B2

(12) United States Patent
Kim et al.

(10) Patent No.: US 8,297,337 B2
(45) Date of Patent: Oct. 30, 2012

(54) INTEGRATED MANAGEMENT SYSTEM AND METHOD FOR MOLTEN ALUMINUM

(75) Inventors: Eok Soo Kim, Ulsan (KR); Young Myung Hong, Ulsan (KR); Kyung Mook Lim, Seoul (KR)

(73) Assignee: Korea Institute of Industrial Technology, Cheonan-si (KR)

( * ) Notice: Subject to any disclaimer, the term of this patent is extended or adjusted under 35 U.S.C. 154(b) by 212 days.

(21) Appl. No.: 12/721,156

(22) Filed: Mar. 10, 2010

(65) Prior Publication Data

US 2010/0230065 A1 Sep. 16, 2010

(30) Foreign Application Priority Data

Mar. 13, 2009 (KR) ..... 10-2009-0021508

(51) Int. Cl.
*B22D 46/00* (2006.01)
*B22D 2/00* (2006.01)

(52) U.S. Cl. ..... 164/4.1; 164/150.1

(58) Field of Classification Search ..... 164/4.1, 164/150.1, 154.1; 700/145, 146, 147
See application file for complete search history.

(56) References Cited

U.S. PATENT DOCUMENTS 6,675,870 B2 * 1/2004 Tilak ..... 164/487
7,039,552 B2 * 5/2006 Zhang et al. ..... 702/182
2009/0138223 A1 * 5/2009 Kim et al. ..... 702/81

* cited by examiner

*Primary Examiner* — Kevin P Kerns
(74) *Attorney, Agent, or Firm* — Reinhart Boerner Van Deuren P.C.

(57) ABSTRACT

An integrated management system for molten aluminum includes a melting process management system, which melts aluminum raw material, taps molten aluminum, and extracts information related to the molten aluminum; a recording medium attached to a high-heat-retention ladle, which is for carrying the molten aluminum, wherein the extracted information is recorded into the recording medium; a portable terminal, which reads the information from the recording medium; and a casting process management system, which manages delivery confirmation and inspection by receiving the information from the transported high-heat-retention ladle via the portable terminal and performs a casting process based on the information. The integrated management system and method ensures improved and efficient process management based on correct molten aluminum information, thereby reducing management costs and time.

16 Claims, 2 Drawing Sheets

INTEGRATED MANAGEMENT SYSTEM AND METHOD FOR MOLTEN ALUMINUM

CROSS REFERENCE TO RELATED APPLICATION

The present application claims priority from Korean Patent Application Number 10-2009-0021508, filed on Mar. 13, 2009, the entire contents of which application is incorporated herein for all purposes by this reference.

BACKGROUND OF THE INVENTION

1. Field of the Invention

The present invention relates to an integrated management system and method for molten aluminum, and more particularly, to an integrated management system and method for molten aluminum that can integrally manage processes of carrying and supplying molten alloy, produced from raw material in a plant, into a casting process using a ladle having excellent heat-retention characteristics without requiring the molten alloy to be manufactured into an ingot.

2. Description of Related Art

Recently, with the onset of problems related to industrialization, such as soaring oil prices, environmental pollution, and global warming, the motorcar industry, fingered as a key source of these problems, is endeavoring to overcome such global problems. As the most fundamental and effective approach, improving fuel efficiency by decreasing the weight of vehicles is gaining attention.

Thus, lightweight materials are rising as the most efficient technology for solving both the problem of soaring oil prices and the problem of environmental pollution while improving the fuel efficiency of transporting vehicles. In particular, aluminum alloys are gathering popularity since they are lightweight materials that can reduce weight by about 50% or more when used to replace steel components.

To cast such aluminum alloys, a solid ingot is manufactured through melting, alloying, and molten aluminum treatment and is then delivered to a casting plant (e.g., for die casting). In the casting plant, the ingot is melted again in a quick-melting furnace, and is then carried to a heat-retaining furnace, where casting takes place.

When the ingot is delivered from an alloying plant, where alloys are manufactured from aluminum raw materials, to the casting plant, quality and production-related information is confirmed as written on a mill sheet since the ingot is generally manufactured in the alloying plant. Quality inspection in the casting plant determines the properties of the material by inspecting the exterior of the solid metal or sampling the solid metal (i.e., ingot) and measuring composition and gas content.

A high-heat-retention ladle capable of obviating the melting of aluminum in the casting can be used. Specifically, the high-heat-retention ladle can be used to carry or purchase aluminum raw material in a molten metal (i.e., molten aluminum) state from the aluminum alloying plant, which is located an intermediate or long distance away. In this case, however, it is difficult to integrally manage the molten metal since a purchasing party has difficulties in confirming the quality of the molten metal and pieces of data about related processing are handled separately.

The information disclosed in this Background of the Invention section is only for the enhancement of understanding of the background of the invention and should not be taken as an acknowledgment or any form of suggestion that this information forms a prior art that would already be known to a person skilled in the art.

BRIEF SUMMARY OF THE INVENTION

Various aspects of the present invention provide an integration management system and method for molten aluminum that can integrally manage molten aluminum by efficiently sharing quality and production information of the molten aluminum, which is carried in the form of molten metal.

In an aspect of the present invention, the integrated management system for molten aluminum may include a melting process management system, which melts aluminum raw material, taps molten aluminum, and extracts information related to the molten aluminum; a recording medium attached to a high-heat-retention ladle, which is for carrying the molten aluminum, wherein the extracted information is recorded into the recording medium; a portable terminal, which reads the information from the recording medium; and a casting process management system, which manages delivery confirmation and inspection by receiving the information from the transported high-heat-retention ladle via the portable terminal and performs a casting process based on the information.

In an exemplary embodiment of the invention, the melting process management system may include a melting furnace, which melts the aluminum raw material and taps the molten aluminum; a melting furnace-controlling section, which controls the operation of the melting furnace and inspects the quality of the molten aluminum tapped out of the melting furnace; and a communicating section, which receives the information related to the molten aluminum from the melting furnace-controlling section and transmits the received information to an external server.

In an exemplary embodiment of the invention, the integrated management system may further include a melting furnace management server, which receives the information related to the molten aluminum via the communicating section and manages the received information; and a melting process Database (DB), which stores the received information.

In an exemplary embodiment of the invention, the casting process management system may include a heat-retaining furnace, which stores the molten aluminum, supplied from the high-heat-retention ladle, by retaining the heat of the molten aluminum; a heat-retaining furnace-controlling section, which controls the operation of the heat-retaining furnace based on the information supplied from the recording medium via the portable terminal; and a communicating section, which transmits the processed information to an external server.

In an exemplary embodiment of the invention, the integrated management system may further include a casting process management server, which receives the processed information via the communicating section and manages the received information; and a casting process DB, which stores the received information.

In an exemplary embodiment of the invention, the recording medium may be a Radio Frequency Identification (RFID) tag or bar codes.

In an exemplary embodiment of the invention, the quality information and production information of the molten aluminum may be recorded into the recording medium.

In an exemplary embodiment of the invention, the quality information may include the temperature, gas content, and composition of the molten aluminum.

In an exemplary embodiment of the invention, the production information may include the production lot, weight, alloy standard, and manufacturer of the molten aluminum.

In an exemplary embodiment of the invention, the portable terminal can be a Personal Digital Assistant (PDA).

In an exemplary embodiment of the invention, the high-heat-retention ladle may have a multi-stage lining structure of refractory-heat insulation materials, in which two types of neutral amorphous refractory materials and two types of fiber glass-formed refractory materials are stacked on one another.

In another aspect of the present invention, integrated management method for molten aluminum may include steps of: extracting quality information and production information related to molten aluminum tapped out of a melting furnace; recording the extracted information into a recording medium; attaching the recording medium to a high-heat-retention ladle, which is for carrying the molten aluminum; transporting the high-heat-retention ladle, to which the recording medium is attached, to a casting process; and managing delivery and inspection of the molten medium by reading the information related to the molten aluminum from the recording medium attached to the high-heat-retention ladle.

In an exemplary embodiment of the invention, the integrated management method may further include steps of: transmitting information related to the delivery and inspection together with the read information to an external server.

According to exemplary embodiments of the present invention as set forth above, the integrated management system and method for molten aluminum can carry molten aluminum in a high-heat-retention ladle to a post process by recording information related to the molten aluminum on the ladle and perform integrated management over the information related to the molten aluminum by sharing the quality and production information of the molten aluminum via the management server. Accordingly, the integrated management system and method can ensure improved and efficient process management based on correct molten aluminum information, thereby reducing management costs and time.

The methods and apparatuses of the present invention have other features and advantages which will be apparent from, or are set forth in greater detail in, the accompanying drawings, which are incorporated herein, and in the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments that may be included within the spirit and scope of the invention as defined by the appended claims.

Figure 1:
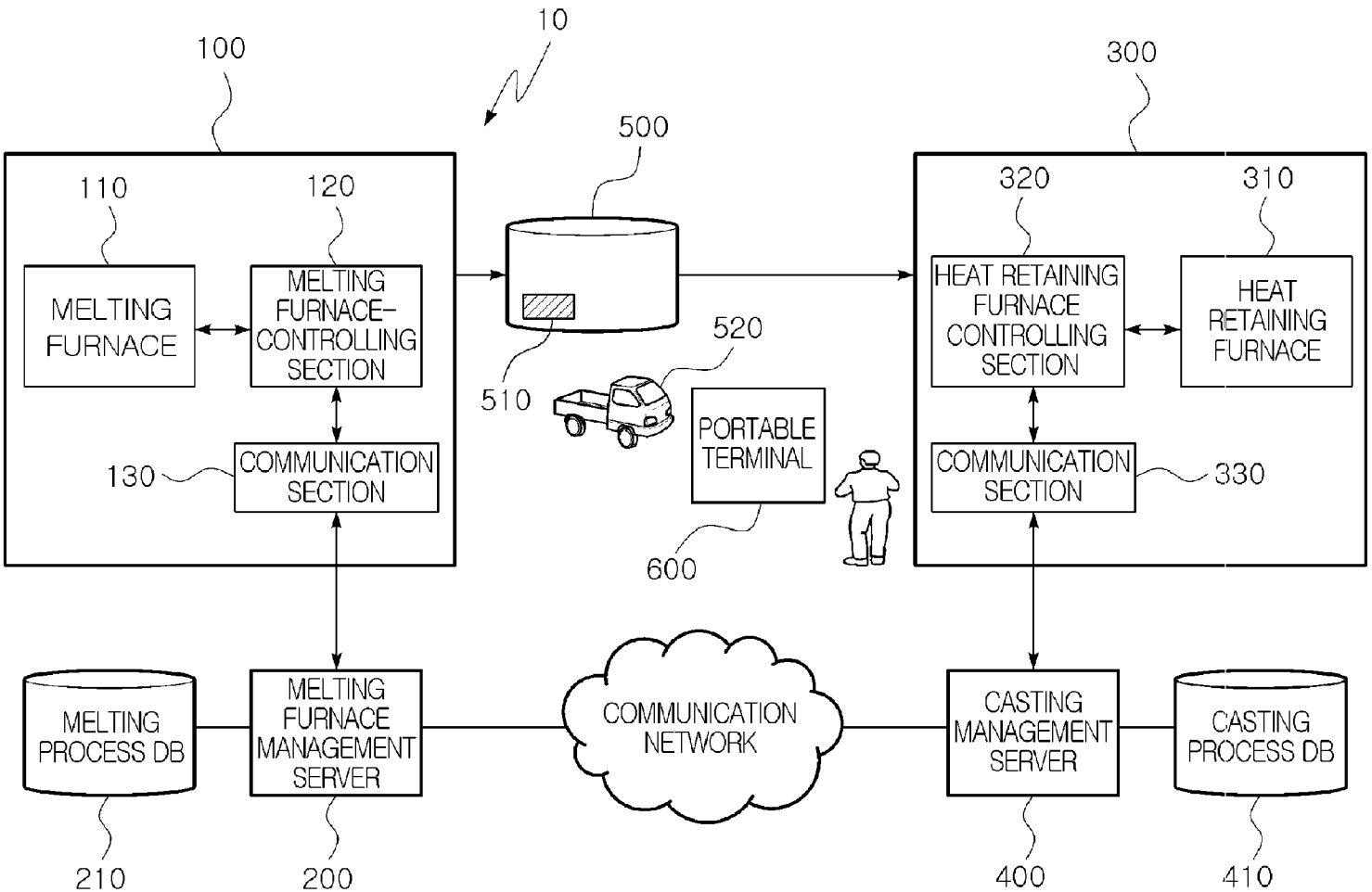
FIG. 1 is a configuration view showing an integrated management system for molten aluminum according to an exemplary embodiment of the invention.

FIG. 1 is a configuration view showing an integrated management system 10 for molten aluminum according to an exemplary embodiment of the invention.

The integrated management system 10 for molten aluminum includes a melting process management system 100, a melting furnace management server 200, a casting process management system 300, a casting process management server 400, a high-heat-retention ladle 500, and a portable terminal 600. The melting process management system 100 serves to manage a process of melting aluminum raw material, tapping molten aluminum, and extracting pieces of information related to the molten aluminum. The melting furnace management server 200 receives the information related to the molten aluminum from the melting process management system 100 and manages the received information related to the molten aluminum. The casting process management system 300 performs casting based on information read from the transported high-heat-retention ladle 500. The casting process management server 400 receives related information from the casting process management system 300 and manages the received information. On the high-heat-retention ladle 500, a recording medium 510, into which the information related to the molten aluminum is recorded, is attached. The portable terminal 600 reads information from the recording medium 510.

Extraction of Information of Molten Aluminum

The melting process management system 100 includes a melting furnace 110, which melts aluminum raw material, a melting furnace-controlling section 120, which controls the operation of the melting furnace 110, and a communicating section 130, which transmits information related to the molten aluminum to the melting furnace management server 200.

The melting furnace 110 serves to melt the aluminum raw material, which is charged thereinto, into molten aluminum, which is then tapped out of the molten aluminum.

The melting furnace-controlling section 120 manages reference information necessary for a melting process. The reference information can be any type of information that acts as a reference for processing production items, process, pieces of equipment, reasons for stopped operations, or the like into information by registration, correction, inquiry, cancellation, or the like. The melting furnace-controlling section 120 also serves to monitor information pertaining to the operation of the melting furnace 110, such as operation status, temperature, and the like.

In addition, the melting furnace-controlling section 110 controls the operation of the melting furnace 110, inspects the quality of the molten aluminum tapped out of the melting furnace 110, and collects and calculates operation and inspection information from the melting furnace 110.

Preferably, quality information acting as a reference of inspection may include, for example, temperature, gas content, and composition of the molten aluminum, and production information related to the operation of the melting furnace 110 may include, for example, production lot, weight, alloy standard, and manufacturer of the molten aluminum.

The communicating section 130 receives the information related to the molten aluminum, such as the quality information and the production information, from the melting furnace-controlling section 120, and transmits the received information to the melting furnace management server 200.

For this, the communicating section 130 communicates with the melting furnace management server 200 via, for example, Ethernet.

The melting furnace management server 200 receives the information related to the molten aluminum via, for example, Ethernet from the communicating section 130 and stores the received information in a melting process database (DB) 210.

The melting furnace management server 200 ensures reliability of data by transmitting melting information to the casting process management server 400 over a web, and estimates output and the like in advance by receiving pieces of information, such as actual results of casting and delivery information.

The casting process management system 300 includes a heat-retaining furnace 310, which stores the supplied molten aluminum by retaining the heat of the molten aluminum, a heat-retaining furnace-controlling section 320, which controls the operation of the heat-retaining furnace 310, and a communicating section 330, which transmits related information to the melting furnace management server 200.

The heat-retaining furnace 310 stores the molten aluminum supplied from the high-heat-retention ladle 500, which carries the molten aluminum, by retaining the heat of the molten aluminum.

The heat-retaining furnace-controlling section 320 manages reference information necessary for a casting process. The reference information can be any type of information that acts as a reference for processing production items, process, pieces of equipment, reasons for stopped operations, or the like into information by registration, correction, inquiry, cancellation, or the like. The heat-retaining furnace-controlling section 320 also serves to monitor the heat-retaining furnace 310 and the operation information of the casting process, such as information on whether or not the furnace is operating, amounts, defects, or the like.

In addition, the heat-retaining furnace-controlling section 320 receives the information related to the molten aluminum from the recording medium 510, attached to the transported high-heat-retention ladle 500, via the portable terminal 600, controls the operation of the heat-retaining furnace 310, manages delivery and inspection of the molten aluminum, and collects and calculates information pertaining to the operation of the heat-retaining furnace 310, such as the amount of use, information on the casting process, and information on the delivery and inspection.

The communicating section 330 receives the delivery and inspection information from heat-retaining furnace-controlling section 320, and transmits the received information to the casting process management server 400. The communicating section 330 communicates with the casting process management server 400 via, for example, Ethernet.

The casting process management server 400 receives processed information via, for example, the Ethernet, and stores the received information in a casting process DB 410, which stores the received information.

The casting process management server 400 confirms whether or not the molten aluminum is properly delivered by transmitting the delivery and inspection information to the melting furnace management server 200 via web.

Transfer of Information of Molten Aluminum

The high-heat-retention ladle 500 contains the molten aluminum tapped out of the melting furnace 110 and is then transported on a transporting vehicle to the casting process management system 300.

The high-heat-retention ladle 500 is a high-heat-retention vessel that is designed to carry molten aluminum and has a multi-stage structure made of a special heat insulation material. The high-heat-retention ladle 500 does not use a heating element, but its material is selected in consideration of reactivity with an ADC aluminum alloy used in the processing, in particular, the casting of molten aluminum.

It is preferable that the high-heat-retention ladle 500 have a lining structure that can absorb shocks while ensuring excellent heat resistance in order to protect the ladle from being damaged by shocks while the ladle is carrying the molten aluminum and prevent a gab due to a difference in shrinkage or a fracture due to a difference in deformation during hardening of refractory material. Preferably, the lining structure including the refractory and heat insulation materials can be a multi-stage structure, in which two types of neutral amorphous refractory materials and two types of fiber glass-formed refractory materials are stacked on one another.

The high-heat-retention ladle 500 is designed to have a capacity of 1000 kg/ch or more, with a maximum temperature drop per minute set to 1.0° C. or less, in order to make it easy to carry the molten aluminum. Since the temperature of the molten aluminum is on the order of 750° C. when it is tapped out, the high-heat-retention ladle 500 can contain the molten aluminum for 8 hours or more before the molten aluminum completely solidifies.

The recording medium 510 records therein the quality information and the production information of the molten aluminum, extracted from the melting process management system 100, and is attached to the high-heat-retention ladle 500, which is for carrying the molten aluminum. Preferably, the information of the molten aluminum carried by the recording medium 510 can include the quality information, such as temperature, gas content, and composition of the molten aluminum, and the production information, such as production lot, weight, alloy standard, and manufacturer of the molten aluminum The recording medium 510 can be a Radio Frequency Identification (RFID) tag or bar codes. Considering that the temperature of the outer shell of the high-heat-retention ladle 500, which is for carrying the molten aluminum, is from 50 to 60° C., the RFID tag is preferable since it has good durability.

The portable terminal 600 reads the information related to the molten aluminum from the recording medium 510 attached to the high-heat-retention ladle 500, which is for carrying the molten aluminum, and transmits the read information to the casting process management system 300 and the melting furnace management server 200. Preferably, the portable terminal can be a Personal Digital Assistant (PDA).

In the integrated management system 10 for molten aluminum according to an exemplary embodiment of the invention configured as above, when the molten aluminum tapped out of the melting furnace 110 is supplied to the high-heat-retention ladle 500, the melting furnace-controlling section 120 extracts the quality and production information related to the molten aluminum and records the extracted information into the record medium 510, which is then attached to the high-heat-retention ladle 500.

The high-heat-retention ladle 500, to which the recording medium 510 is attached, is loaded on a transporting vehicle 520 and is transported on the transporting vehicle 520 to the casting process. As a user reads the information of the molten aluminum via the portable terminal 600, which can read the recording medium 510, heat-retaining furnace-controlling section 320 manages delivery and inspection of the molten aluminum.

According to the configuration as described above, the integrated management system 10 for molten aluminum can ensure improved and efficient process management based on correct molten aluminum information, thereby reducing management costs and time.

Below, with reference to FIG. 2, a description will be given of an integrated management method of molten aluminum according to an exemplary embodiment of the invention.

Figure 2:
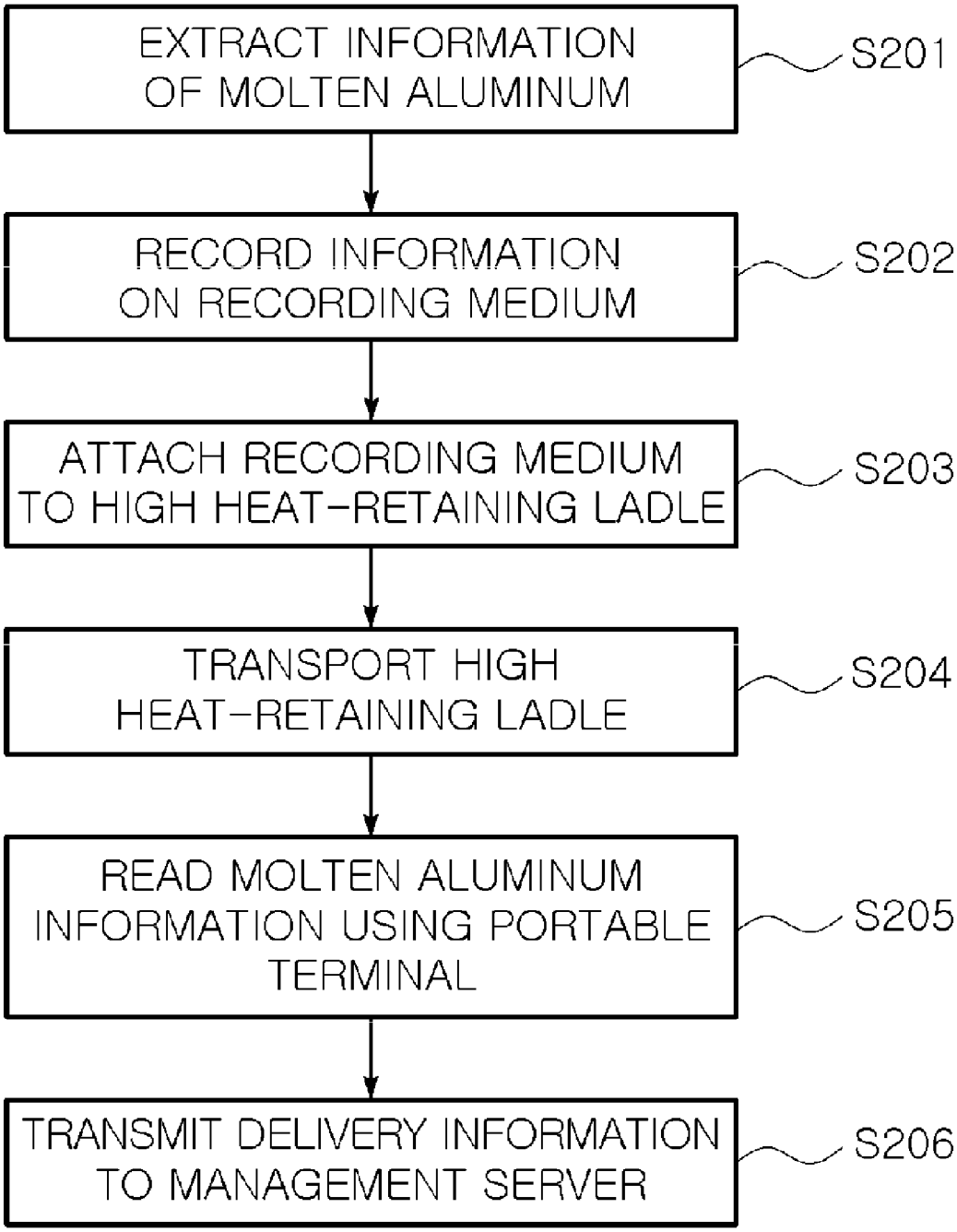
FIG. 2 is a flowchart showing an integrated management method for molten aluminum according to an exemplary embodiment of the invention.

FIG. 2 is a flowchart showing an integrated management method for molten aluminum according to an exemplary embodiment of the invention.

The integrated management method for molten aluminum includes steps of extracting information of molten aluminum in S201, recording the extracted information of molten aluminum on a recording medium 510 in S202, attaching the recording medium 510 onto the high-heat-retention ladle 500 in S203, transporting the high-heat-retention ladle 500 in S204, reading the information of molten aluminum using the portable terminal 600 in S205, and transmitting delivery and inspection result to the management server in S206.

More particularly, first in S201, the melting furnace-controlling section 120 extracts information related to molten aluminum, tapped out of the melting furnace 120, for example, quality information such as temperature, gas content, and composition of the molten aluminum, and production information such as production lot, weight, alloy standard, and manufacturer of the molten aluminum.

In S202, the melting furnace-controlling section 120 records the information of the extracted molten aluminum into the recording medium. Here, available examples of the recording medium 510 may include an RFID tag or bar codes, and preferably, be an RFID tag.

In S203, the recording medium 510 is attached to the high-heat-retention ladle 500 that is for carrying the molten aluminum. In the high-heat-retention ladle 500, it is preferable that maximum temperature drop per minute be 1.0° C. or less in order to prevent the molten aluminum from solidifying for a long time.

The high-heat-retention ladle 500, to which the recording medium 510 is attached, is loaded on the transporting vehicle 520 and is then transmitted to a casting process on the transporting vehicle 520 in S204. Here, the transportation distance can be two hours' distance or less in consideration of maximum temperature drop of the high-heat-retention ladle 500.

In S205, the information related to the molten aluminum is read from the recording medium 510, attached to the transported high-heat-retention ladle 500, using the portable terminal 600 that can read the recording medium 510.

Here, the heat-retaining furnace-controlling section 320 manages delivery and inspection of the molten aluminum by receiving the read information from the portable terminal 600.

The heat-retaining furnace-controlling section 320 transmits the delivery and inspection information to the melting furnace management server 200 and the casting process management server 400 in S206. Here, the heat-retaining furnace-controlling section 320 transmits delivery confirmation information to the melting furnace management server 200 and the quality information of the molten aluminum to the casting process management server 400.

As described above, the integrated management method for molten aluminum can ensure improved and efficient process management based on correct molten aluminum information, thereby reducing management costs and time.

The foregoing descriptions of specific exemplary embodiments of the present invention have been presented for the purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An integrated management system for molten aluminum comprising:

a melting process management system, which melts aluminum raw material, taps molten aluminum, and extracts information related to the molten aluminum;

a recording medium for storing information attached to a high-heat-retention ladle, which is for carrying the molten aluminum, the high-heat-retention ladle and recording medium being transportable by a transport device from a melting location where the aluminum raw material is melted to a casting location, wherein the extracted information is stored in the recording medium and transferred from the melting location to the casting location by the transport device;

a portable terminal, which reads the information from the recording medium; and a casting process management system, which manages delivery confirmation and inspection by receiving the information from the transported high-heat-retention ladle via the portable terminal and performs a casting process based on the information.

2. The integrated management system according to claim 1, wherein the melting process management system includes:

a melting furnace, which melts the aluminum raw material and taps the molten aluminum;

a melting furnace-controlling section, which controls an operation of the melting furnace and inspects quality of the molten aluminum tapped out of the melting furnace; and a communicating section, which receives the information related to the molten aluminum from the melting furnace-controlling section and transmits the received information to an external server.

3. The integrated management system according to claim 2, further comprising:

a melting furnace management server, which receives the information related to the molten aluminum via the communicating section and manages the received information; and a melting process database, which stores the received information.

4. The integrated management system according to claim 1, wherein the casting process management system includes:

a heat-retaining furnace, which stores the molten aluminum, supplied from the high-heat-retention ladle, by retaining heat of the molten aluminum;

a heat-retaining furnace-controlling section, which controls an operation of the heat-retaining furnace based on the information supplied from the recording medium via the portable terminal; and a communicating section, which transmits the processed information to an external server.

5. The integrated management system according to claim 4, further comprising:

a casting process management server, which receives the processed information via the communicating section and manages the received information; and a casting process database, which stores the received information.

6. The integrated management system according to claim 1, wherein the recording medium comprises a radio frequency identification tag or bar codes.

7. The integrated management system according to claim 1, wherein quality information and production information of the molten aluminum are recorded into the recording medium.

8. The integrated management system according to claim 7, wherein the quality information includes temperature, gas content, and composition of the molten aluminum.

9. The integrated management system according to claim 7, wherein the production information includes production lot, weight, alloy standard, and manufacturer of the molten aluminum.

10. The integrated management system according to claim 1, wherein the portable terminal comprises a personal digital assistant.

11. The integrated management system according to claim 1, wherein the high-heat-retention ladle has a multi-stage lining structure of refractory-heat insulation materials, in which two types of neutral amorphous refractory materials and two types of fiber glass-formed refractory materials are stacked on one another.

12. The integrated management system according to claim 1, wherein the high-heat-retention ladle is transportable with molten aluminum therein.

13. The integrated management system of claim 12, wherein the recording medium is transported with the high-heat-retention ladle.

14. The integrated management system of claim 1, wherein the recording medium is mounted to the high-heat-retention ladle.

15. An integrated management method for molten aluminum comprising:

extracting quality information and production information related to molten aluminum tapped out of a melting furnace at a melting location;

storing the extracted information in a recording medium;

attaching the recording medium to a high-heat-retention ladle, which is for carrying the molten aluminum;

transporting the high-heat-retention ladle and the recording medium in which the extracted information is stored from the melting location to a casting process at a casting location using a transport device; and managing delivery and inspection of the molten aluminum medium by reading the information related to the molten aluminum from the recording medium attached to the high-heat-retention ladle at the casting location.

16. The integrated management method according to claim 15, further comprising transmitting information related to the delivery and inspection together with the read information to an external server.

* * * * *